US011667425B2

(12) United States Patent
Niehoff et al.

(10) Patent No.: US 11,667,425 B2
(45) **Date of Patent: *Jun. 6, 2023**

(54) VACUUM DRUM FOR A LABELING UNIT, AND LABELING UNIT COMPRISING A VACUUM DRUM OF THIS TYPE

(71) Applicant: KHS GmbH, Dortmund (DE)

(72) Inventors: Patrick Niehoff, Bochum (DE); Gerhard Klöpper, Hamburg (DE); Lutz Deckert, Haltern Am See (DE); Daniel Schleweis, Hamburg (DE)

(73) Assignee: KHS GmbH, Dortmund (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/628,589

(22) PCT Filed: Jul. 22, 2020

(86) PCT No.: PCT/EP2020/070618
§ 371 (c)(1),
(2) Date: Jan. 20, 2022

(87) PCT Pub. No.: WO2021/023509
PCT Pub. Date: Feb. 11, 2021

(65) Prior Publication Data

US 2022/0250781 A1 Aug. 11, 2022

(30) Foreign Application Priority Data

Aug. 8, 2019 (DE) ..... 10 2019 121 445.9

(51) Int. Cl.
*B65C 9/18* (2006.01)
*B65C 9/22* (2006.01)
(Continued)

(52) U.S. Cl.
CPC ..... *B65C 9/1819* (2013.01); *B65C 9/22* (2013.01); *B65C 3/08* (2013.01); *B65C 3/163* (2013.01); *Y10T 156/1033* (2015.01)

(58) Field of Classification Search
CPC ... Y10T 156/1033; B65C 9/1819; B65C 9/20; B65C 9/22; B65C 9/2247; B65C 9/2252;
(Continued)

(56) References Cited

U.S. PATENT DOCUMENTS 3,864,187 A 2/1975 Carter
4,032,388 A 6/1977 Dunning
(Continued)

FOREIGN PATENT DOCUMENTS

CN 101600624 A 12/2009
DE 102006051359 A1 4/2008
(Continued)

OTHER PUBLICATIONS

International Search Report and Written Opinion, PCT Application No. PCT/EP2020/070618, dated Nov. 17, 2020 (16 pages).

*Primary Examiner* — Carson Gross
(74) *Attorney, Agent, or Firm* — Occhiuti & Rohlicek LLP

(57) ABSTRACT

A labeling apparatus includes a rotating vacuum drum and a pair of vacuum holders on the drum that are switched by rotating switches between a working position for gluing labels and a rest position in which the vacuum holders avoid an application of glue. Actuators cause the switches to transition between operating positions. Stationary switch controllers initiate transitions between the operating positions of the switch, thereby causing the holders to transition between their two positions.

14 Claims, 9 Drawing Sheets

(51) Int. Cl.
*B65C 3/16* (2006.01)
*B65C 3/08* (2006.01)

(58) Field of Classification Search
CPC .... B65C 9/26; B65C 3/06; B65C 3/08; B65C 3/16; B65C 3/163; B65C 2009/0071
See application file for complete search history.

(56) References Cited

U.S. PATENT DOCUMENTS

| | | | | |
|---|---|---|---|---|
| 4,354,887 | A | 10/1982 | Total | |
| 4,735,668 | A | 4/1988 | Hoffmann et al. | |
| 4,758,300 | A * | 7/1988 | King | B65C 9/1819 156/578 |
| 4,801,348 | A | 1/1989 | Takagaki | |
| 5,344,519 | A | 9/1994 | Galchefski et al. | |
| 2018/0186493 | A1 * | 7/2018 | Hafner | B29C 66/92 |

FOREIGN PATENT DOCUMENTS

| | | | |
|---|---|---|---|
| DE | 102015214011 | A1 | 1/2017 |
| EP | 0261861 | A2 | 3/1988 |
| EP | 1052209 | A1 | 11/2000 |

* cited by examiner

VACUUM DRUM FOR A LABELING UNIT, AND LABELING UNIT COMPRISING A VACUUM DRUM OF THIS TYPE

RELATED APPLICATIONS

This is the national stage of international application PCT/EP2020/070618, filed on Jul. 22, 2020, which claims the benefit of the Aug. 8, 2019 priority date of German application DE102019121445.9, the contents of which are herein incorporated by reference.

FIELD OF INVENTION

The invention relates to labeling containers and in particular, to a vacuum drum used in connection with labeling.

BACKGROUND

In the course of labeling containers, it is known to use a vacuum drum to hold a label by suction. Typically, the container is held by the vacuum drum so that the label's leading edge, which has been treated with adhesive, sticks to the container. The container is then rotated about its axis to draw off the remainder of the label.

Sometimes, faults occur upstream. These faults lead to gaps in the flow of containers. It is useful to avoid having a labeling machine attempt to label a container when no container is present to be labelled, such as when a gap has occurred in the container flow.

Known mechanisms for controlling the labeling process rely on interaction between displaceable control curves beneath the vacuum drum and rollers coupled to the vacuum holders. These must be capable of switching rapidly and transferring relatively high switching forces. The resulting mechanism is loud and prone to wear.

SUMMARY

In one aspect, the invention includes a vacuum drum for a labelling unit of a labelling machine, in particular for the labelling of containers or the like, comprising at least one vacuum-holder pair that can rotate in a direction of rotation about a drum axis of the vacuum drum.

The pair comprises at least two vacuum holders offset to one another on a circumferential surface of the vacuum drum about the drum axis in the direction of rotation. A front vacuum holder holds a front end of label and a rear vacuum holder holds a rear end of the same label. The terms "front" and "rear" are defined in relation to the rotation direction.

The front and rear vacuum holders comprise in each case a rotational switching device that can be switched into two fixed stationary operating positions, with at least one switching element. In addition, by means of the respective rotational switching device, the front and rear vacuum holders are configured so as to be switchable between an inner rest position as a first fixed operating position, in which the vacuum-holder pair is guided so as to avoid contact as it travels past a gluing unit provided next to the vacuum drum, and an outer working position, as a second fixed operating position, in which the vacuum-holder pair is conveyed past the gluing unit such as to come in contact. The respective switching element of an associated rotational switching device can be brought into working engagement with at least two stationary switching devices in order to initiate the switching movements.

The vacuum drum according to the invention therefore represents a bistable system, which in the inner rest position and in the outer working position in each case forms a fixed stationary operating position, i.e. in particular a self-retaining position, without a switching roller of a roller switching device necessarily having to be held or guided.

Due to the configuration of the vacuum drum, it is therefore only necessary for switching to take place in the event of changes of state, i.e. in particular in the event of position gaps occurring in the container transport, or after a more extended gap with several containers missing, with a switch being made upon reinstating a continuous container flow. In the event of more substantial position gaps, with several containers missing, this reduces the number of switching procedures.

Preferably, the switching element can be configured as rotationally symmetric, for example as a switching bolt, which is switched by means of a rotational switching device. As an alternative, the switching element can be configured in the form of a switch tag. In some embodiments, the switch tag's outer configuration is such that the switch tag can be actuated with particularly low noise by the actuation device allocated to it. Among these embodiments are those in which the switch tag has an at least partially convex outer contour.

Embodiments include those in which the switch element comprises plastic and those in which it is a pluggable sleeve that is not rotationally movable. Such embodiments preferably comprise wear-resistant plastic or metal. However, the switch element excludes switching rollers, and in particular, freely-rotatable switching rollers.

In some embodiments, the vacuum drum comprises several segments arranged around the drum axis. Each segment comprises at least one vacuum-holder pair having front and rear vacuum holders that can be switchable separately from one another into the first and/or second fixed stationary operating position by an associated rotational switching device.

Still other embodiments include a front vacuum pad at the front vacuum holder, which is configured so as to be switchable, by means of the front rotational switching device assigned to the front vacuum holder, between the outer working position and the inner rest position, and a rear vacuum pad at the rear vacuum holder, which is configured so as to be switchable by the rear rotational switching device of the rear vacuum holder between the outer working position and the inner working position.

Further embodiments include those in which the rotational switching device comprises a U-shaped carrier element having side limbs between which a pivot axle extends so that it is parallel to the drum's axis and rotatable. Rocker levers are disposed along the axle.

Embodiments further include those in which the rocker levers each comprise a first and second switching surface, both of which interact with a plunger that is subjected to pre-tension by spring force and that is guided in an axially displaceable manner along a base limb that connects the two side limbs of the U-shaped carrier element. The plunger is securely connected on its side opposite the rocker levers to a corresponding front and rear nozzle body respectively, arranged on which are the respective vacuum pads.

In still other embodiments, the rocker levers are securely arranged on the pivot axle to be configured such as to be able to pivot to-and-fro between the first and second fixed stationary operating position, and specifically in such a way that the first stationary operating position is formed at the first switching surface and the second stationary operating position is formed at the second switching surface of the corresponding rocker lever.

In some embodiments, at least two rocker levers are configured such that they can be switched into the first stationary operating position in such a way that the associated front and rear vacuum pad respectively is held securely stationary in the rest position, and that the at least two rocker levers are configured such that they can be switched into the second fixed stationary operating position, in such a way that the associated front or rear vacuum pad is held securely stationary in the working position.

In other embodiments, the initiation of a pivoting movement by the respective switching element, by means of the at least one stationary switching device, the associated pivot axle can be rotated, and, by way of the switching surfaces provided at the rocker lever, the associated plunger can be moved radially outwards or inwards, seen from the drum axis, such that the respective front or rear rotational switching device is switched into its first or second fixed stationary operating position respectively.

In still other embodiments, front switching elements of the associated front vacuum holders have free ends at a common height above a planar base and respective rear switching elements of the associated rear vacuum holders have free ends that are at another common height above the base.

Embodiments also include those in which a stationary switching device comprises a pivotable lever with at least one control surface for initiating a switching movement of the respective front and/or rear rotational switching device by means of their respective switching elements.

Some embodiments feature a first, a second, and a third stationary switching device. The first switching device comprises a first pivotable lever with a first control surface, the second switching device comprises a second pivotable lever with a second control surface, and the third switching device comprises a third pivotable lever with a third and fourth control surface.

In other embodiments, the first stationary switching device is configured such as to press the front switching element of a corresponding front vacuum holder, in each case rotating about the drum axis past the first switching device in the direction of rotation, by means of the first control surface, from the outside inwards in the direction of the drum axis, such that the front rotational switching device can be switched into the first stationary operating position, in which the front vacuum holder is located in the rest position.

In still other embodiments, the second stationary switching device is configured in such a way as to press the rear switching element of a corresponding rear vacuum holder, rotating about the drum axis in each case past the second switching device in the direction of rotation, by means of the second control surface, from the outside inwards in the direction of the drum axis, such that the rear rotational switching device can be switched into the first stationary operating position, in which the rear vacuum holder is located in the rest position.

In yet other embodiments, the third stationary switching device is configured in such a way as to press the front and rear switching elements of a corresponding front and rear vacuum holder, in each case rotating past the third switching device about the drum axis in the direction of rotation, by means of the third and fourth control surface radially from the inside outwards, directed away from the drum axis, such that the front and rear rotational switching device can in each case be switched into the second stationary operating position, in which the front and rear vacuum holders are located in the working position.

The expression "essentially" or "approximately" signify in the meaning of the invention deviations from the exact value in each case by +/−10%, preferably by +/−5%, and/or deviations in the form of changes which are not of significance for the function.

Further embodiments, advantages, and possible applications of the invention also derive from the following description of exemplary embodiments and from the Figures. In this situation, all the features described and/or represented are in principle the object of the invention, alone or in any desired combination, regardless of their connection in the claims or reference to them. The contents of the claims are also deemed to be constituent parts of the description.

Although some aspects have been described in connection with a device, it is understood that these aspects also represent a description of the corresponding method, such that a block element or a structural element of a device is also understood to be a corresponding method step or as a feature of a method step. By analogy with this, aspects which have been described in connection with or as a method step also represent a description of a corresponding block or detail or feature of a corresponding device. Some or all of the method steps can be carried out by a hardware apparatus (or with the use of a hardware apparatus) such as, for example, a microprocessor, a programmable computer, or an electronic circuit. With some exemplary embodiments, some or many of the most important method steps can be carried out by such an apparatus.

BRIEF DESCRIPTION OF THE DRAWINGS

These and other features of the invention will be apparent from the following detailed description and the accompanying figures, in which.

In the figures identical reference numbers are used for elements of the invention which are the same or have the same effect. Moreover, for easier overview, in the individual figures only reference numbers are represented which are required for the description of the respective figure. The invention is also represented in the figures only in schematic views in order to explain the method of working. In particular, the representations in the figures serve only to explain the underlying principle of the invention. For reasons of easier overview, the representation of all the constituent parts of the device has been refrained from.

DETAILED DESCRIPTION

Figure 1:
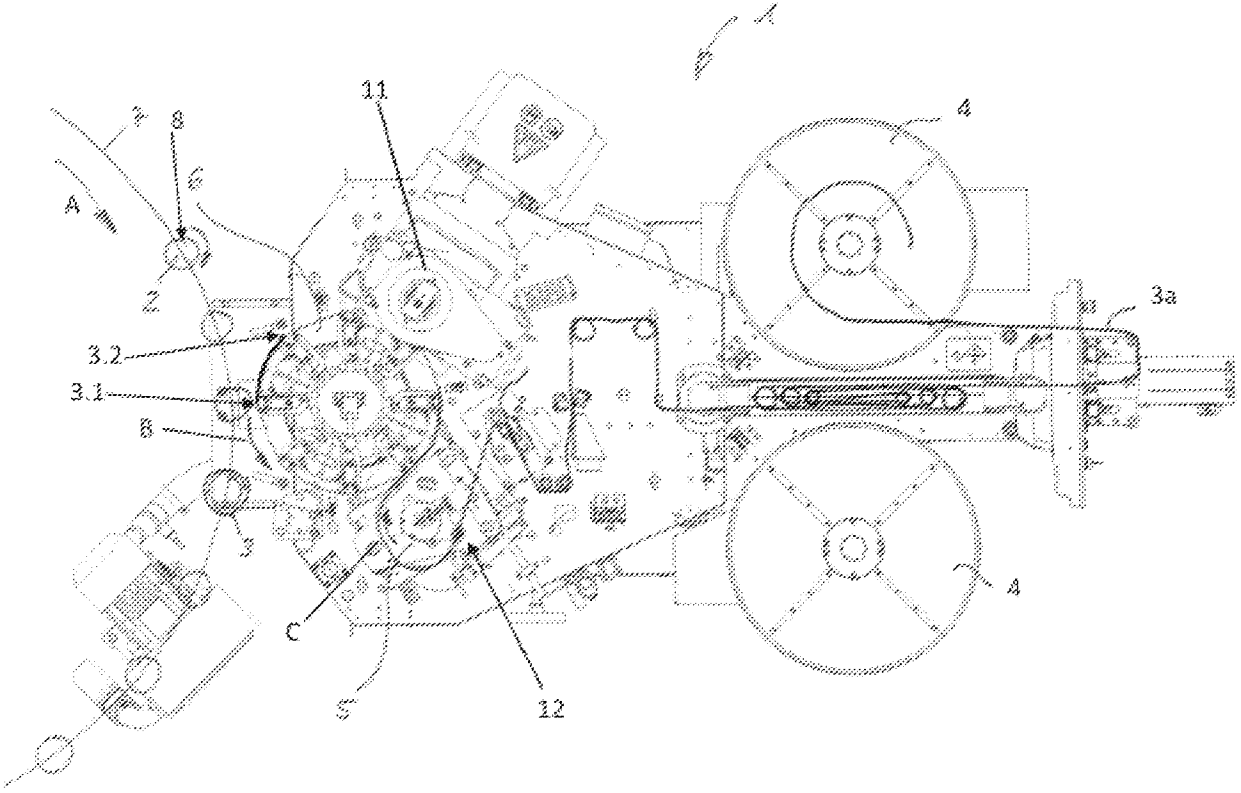
FIG. 1 is a top view of a labeling machine.

FIG. 1 shows a rotor 7 that rotates in a rotor direction "A" as it carries containers 2 past a labeling machine 1. The rotor 7 includes rotary plates 8 disposed along its circumference. These rotary plates 8 form standing surfaces for containers 2 that are brought in via a container inlet. Each container 2 stands on a rotary plate 8.

The labeling machine 1 includes a gluing unit 11, a vacuum drum 6, and a cutter 5.

The gluing unit 11 applies glue on the rear side of each label 3 as it is being held at the circumference of the vacuum drum 6. As the rotor 7 carries the container 2 past the labeling machine 1, the label's leading end 3.1, which has been coated with glue, is transferred to the moving container 2. The rotary plate 8 rotates the container 2 to wind the rest of the label 3 onto the container 2. After having been thus labelled, the container 2 is conveyed away for further processing.

The cutter 5, which includes a cutting drum 12, cuts a length of label material 3*a* that has been drawn from a storage roll 4 by conveyor rollers at a rate that depends on the rotor's rotational speed. The length that is cut by the cutter 5 is that needed for a label 3.

Figure 2:
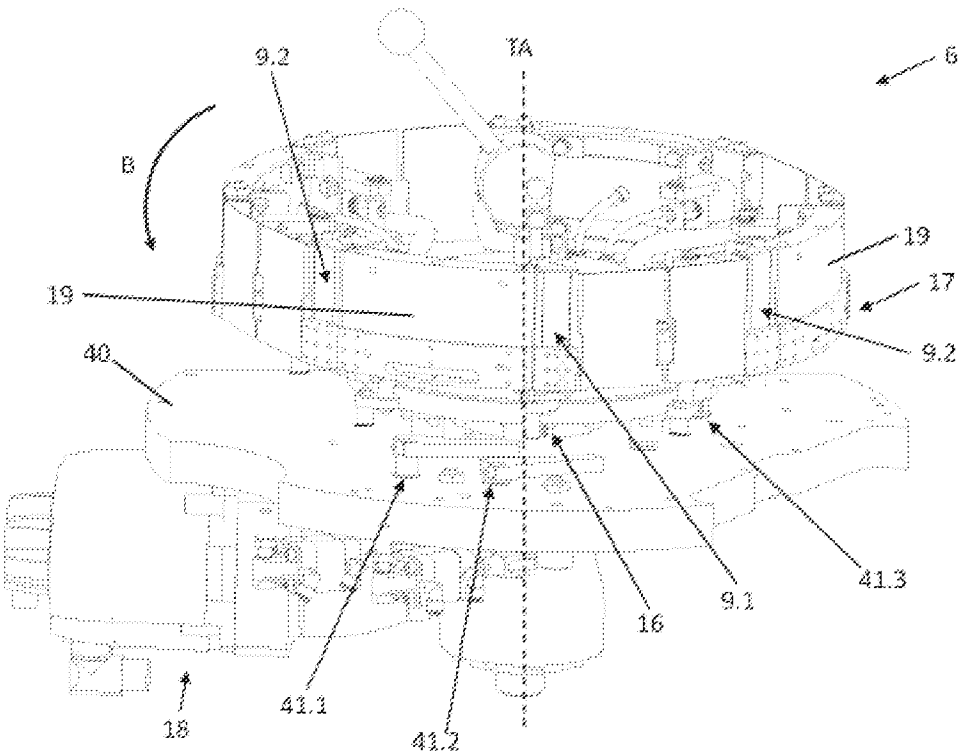
FIG. 2 is an oblique view from above a vacuum drum in the labeling machine of FIG. 1.

The vacuum drum 6 rotates in a vacuum-drum rotation direction "B" about its axis TA, best seen in FIG. 2. The cutting drum 12 rotates in a cutting-drum rotation direction "C" that is opposite the vacuum-drum rotation direction "B." The vacuum drum 6 transfers these labels 3 onto the containers 2 as the rotor 7 carries the containers 2 past the labeling machine 1.

FIG. 2 shows the vacuum drum 6 and its axis TA. The vacuum drum 6 is a transfer drum that comprises identical segments 17. Each segment 17 of the vacuum drum 6 comprises a holder pair 6 having a leading holder 9.1 and a trailing holder 9.2, both of which are vacuum holders that hold by using suction provided by a vacuum source. The holders 9.1, 9.2 are offset from each other along the vacuum-drum's rotation direction B by an amount that corresponds to the label's length. The leading holder 9.1 holds the label's leading end 3.1 and the trailing holder 9.2 holds the label's trailing end 3.2.

Figure 3:
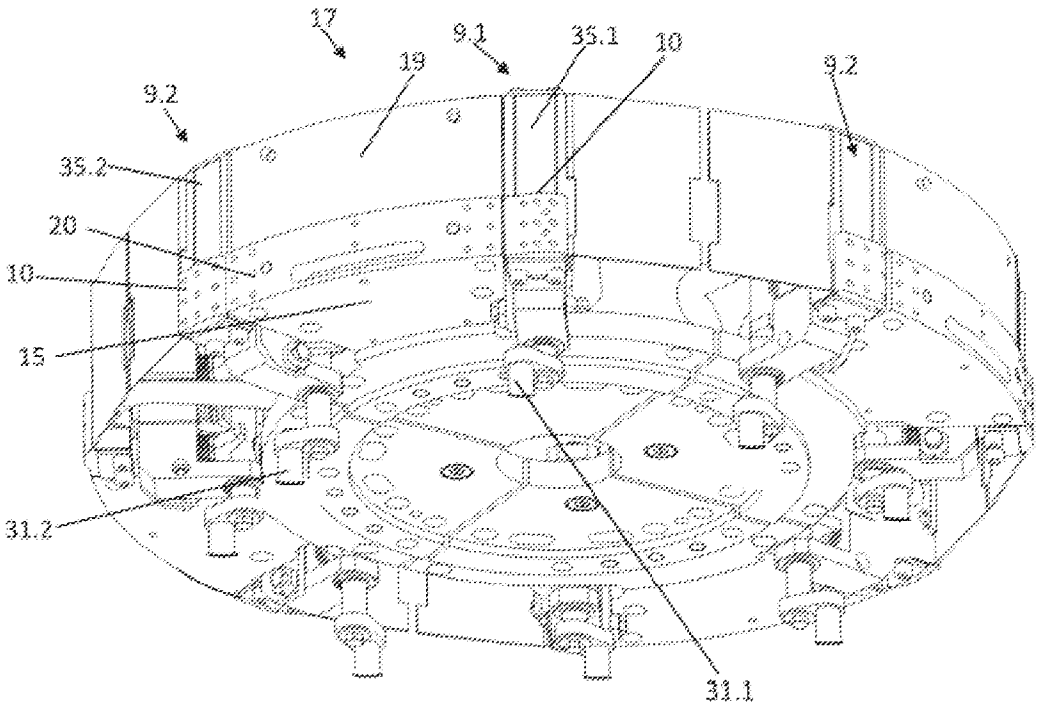
FIG. 3 is an oblique view from below the vacuum drum in the labeling machine of FIG. 1.

FIG. 3 shows vacuum pads 35.1, 35.2 disposed over corresponding vacuum holders 9.1, 9.2. Each vacuum pad 35.1, 35.2 is a strip having a long axis parallel to the drum's axis TA. The vacuum pads 35.1, 35.2 project slightly over the drum's peripheral surface. This projection causes the gluing station 11 to apply glue only to the label's leading end 3.1 and its trailing end 3.2.

Figure 6:
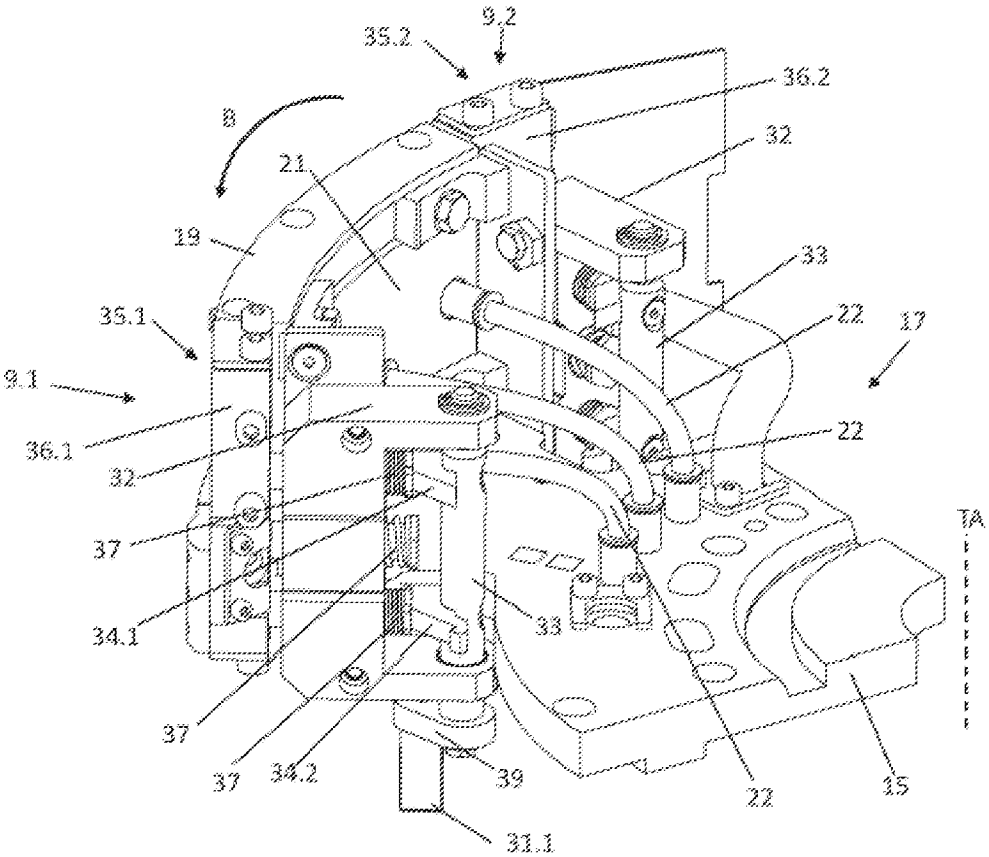
FIG. 6 is a segment of the vacuum drum shown in FIGS. 1-5.

The vacuum pads 35.1, 35.2 each form a hermetically tight seal with a corresponding nozzle body 36.1, 36.2, as shown in FIG. 6. Suction lines 22 then connect openings 10 behind the vacuum pad 35.1, 35.2 to a central vacuum source via a rotary connection. This provides the vacuum needed to hold a label 3.

Figure 8:
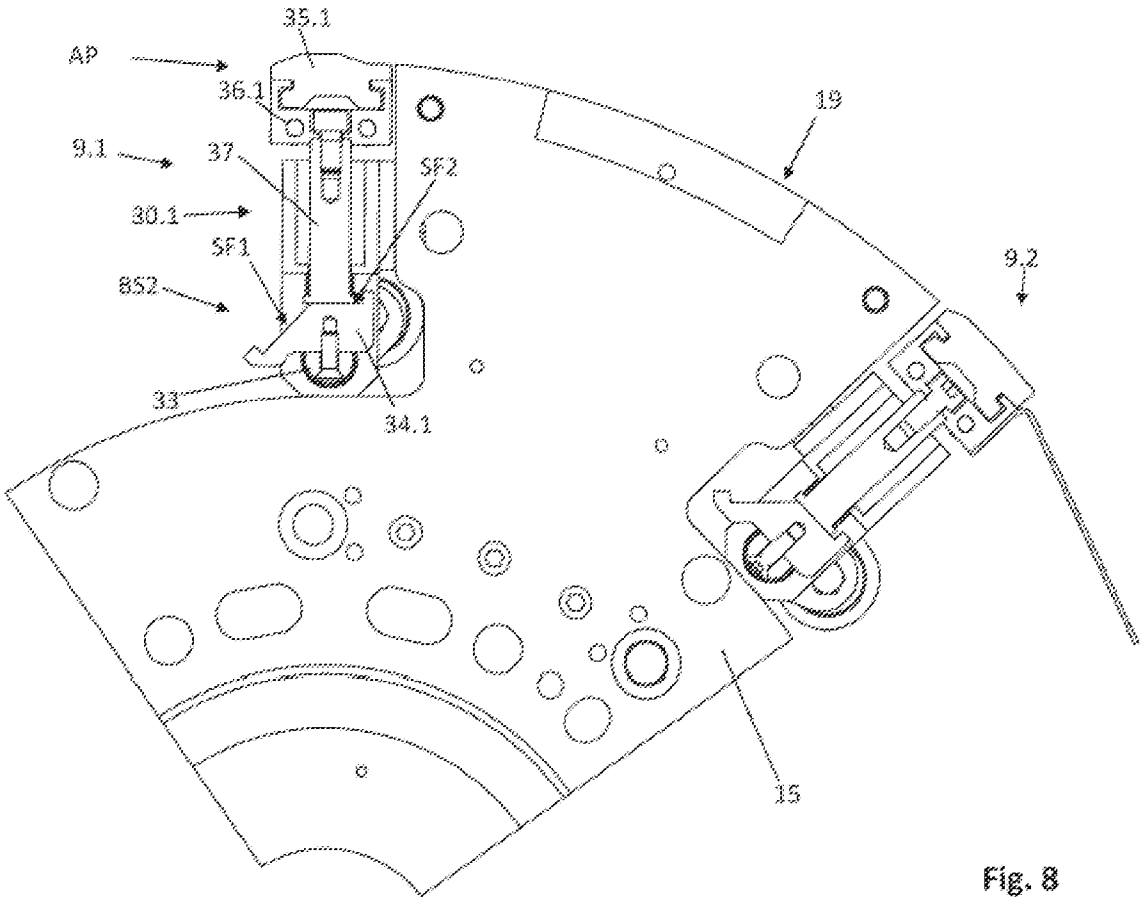
FIG. 8 is a view from above the segment shown in FIGS. 6 and 7 with a front vacuum holder in its working position.
Figure 9:
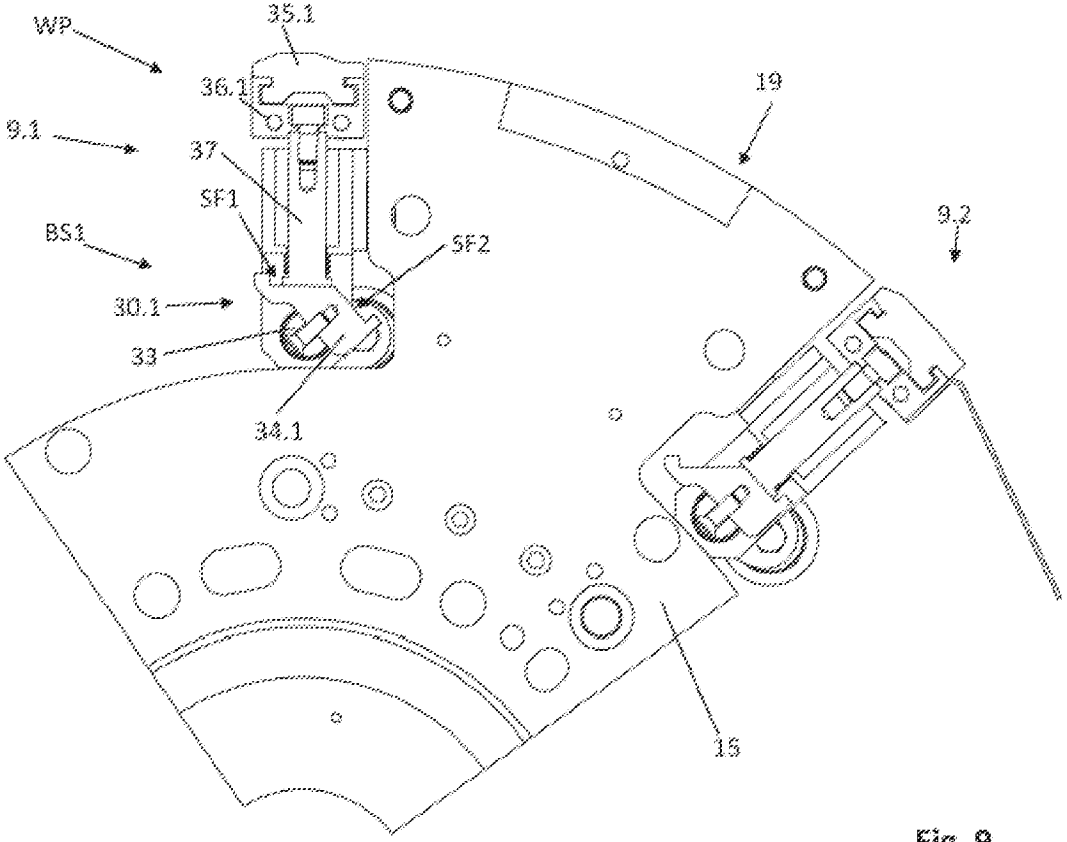
FIG. 9 is a view from above the segment shown in FIGS. 6 and 7 with a front vacuum holder in its resting position.

In operation, switch actuators 31.1, 31.2 cause rotating switches 30.1, 30.2 to transition first and second operating positions BS1, BS2, which can be seen in FIGS. 8 and 9. The switch actuator 31.1, 31.2 is a rotationally symmetric structure that extends longitudinally along an axis. An example of a switch actuator 31.1, 31.2 is bolt.

A transition of the rotating switch 30.1, 30.2 causes its corresponding leading or trailing holder 9.1, 9.2 to transition between an rest position WP, shown in FIG. 9, and an working position AP, shown in FIG. 8. The first operating position BS1 results in the rest position WP and the second operating position BS2 results in the working position AP.

The rest position WP is radially inward relative to the working position AP. As a result, a holder 9.1, 9.2 that is in its rest position WP avoids contact with the gluing unit 11. In contrast, a holder 9.1, 9.2 that is in its working position AP causes the label 3 being held to come into contact with the gluing unit 11.

The working position AP is the holder pair's ordinary working position. It is used when there is a container 2 to be labelled. When in its working position AP, the holder pair 9 guides the label against a gluing unit 11, which can be seen in FIG. 1.

The rest position WP, which is located radially inwards relative to the outer working position AP, is the holder pair's diversion position. This rest position WP is used when a holder pair 9 is not holding a label 3 or when there is no container 2 to label as a result of a gap in container flow.

This ability to switch between rest position WP and working position AP is useful for accommodating a gap in container flow. In particular, if there is no container 2 to be labelled because of a gap in container flow, there is little sense in applying glue to a label being held by the vacuum drum 6. As a result, the drum 6 is configured to be switched into its rest position WP at the beginning of a gap in container flow and to be switched back into its working position AP at the end of that gap.

As shown in FIG. 3, each segment 17 includes a floor defined by a carrier plate 15. The carrier plate 15 is shaped like a sector of a circle. A vertical drive shaft 16, best seen in FIG. 2, passes through a stationary base carrier 40 and connects to the segments 17. A motor 18 that is secured to the underside of the base carrier 40 drives the drive shaft 16. A suitable drive 18 is an electric motor, and in particular, a servomotor.

It is the segment's carrier plate 15 that supports the holder pair 9. A segment wall 19 between the leading holder 9.1 and the trailing holder 9.2 forms the vacuum drum's peripheral surface. FIG. 3 shows suction openings 20 on the segment wall 19. These suction openings 20 connect to a radially-inward vacuum chamber 21 via suction lines 22, as shown in FIG. 6. A rotational connection, which is not shown, ultimately connects to a centralized vacuum source.

As shown in FIG. 6, a rotating switch 30.1, 30.2 comprises a U-shaped carrier element 32 having a pair of side limbs and a base limb connecting the side limbs. An axle 33, which is parallel to the drum axis, extends between these side limbs.

Upper and lower rocker levers 34.1, 34.2 are disposed along the axle 33. At a radially-inward end thereof, the rocker levers 34.1, 34.2 engage the axle 33. At their radially-outward ends, the rocker levers 34.1, 34.2 engage corresponding spring-loaded plungers 37 that are biased in a radially-inward direction to push the rocker levers 34.1, 34.2 into the axle 33.

As can be seen in FIG. 8, each rocker lever 34.1, 34.2 comprises first and second switching surfaces SF1, SF2, one of which is in engagement with the plunger 37. The operating position BS1, BS2 depends on which one of the surfaces SF1, SF2 engages the plunger 37.

The first operating position BS1 occurs when rocker lever's first switching surface SF1 engages the plunger 37. This causes the associated vacuum pads 35.1, 35.2 to be held securely in the rest position WP. The second operating position BS2 occurs when second switching surface SF2 engages the plunger 37. This causes the associated vacuum pads 35.1, 35.2 to be held securely in the working position AP.

Referring now to FIG. 6, each pivot axle 33 connects to a lever 39. Turning this lever 39 changes the state of its corresponding switch actuator 31.1, 31.2.

Figure 4:
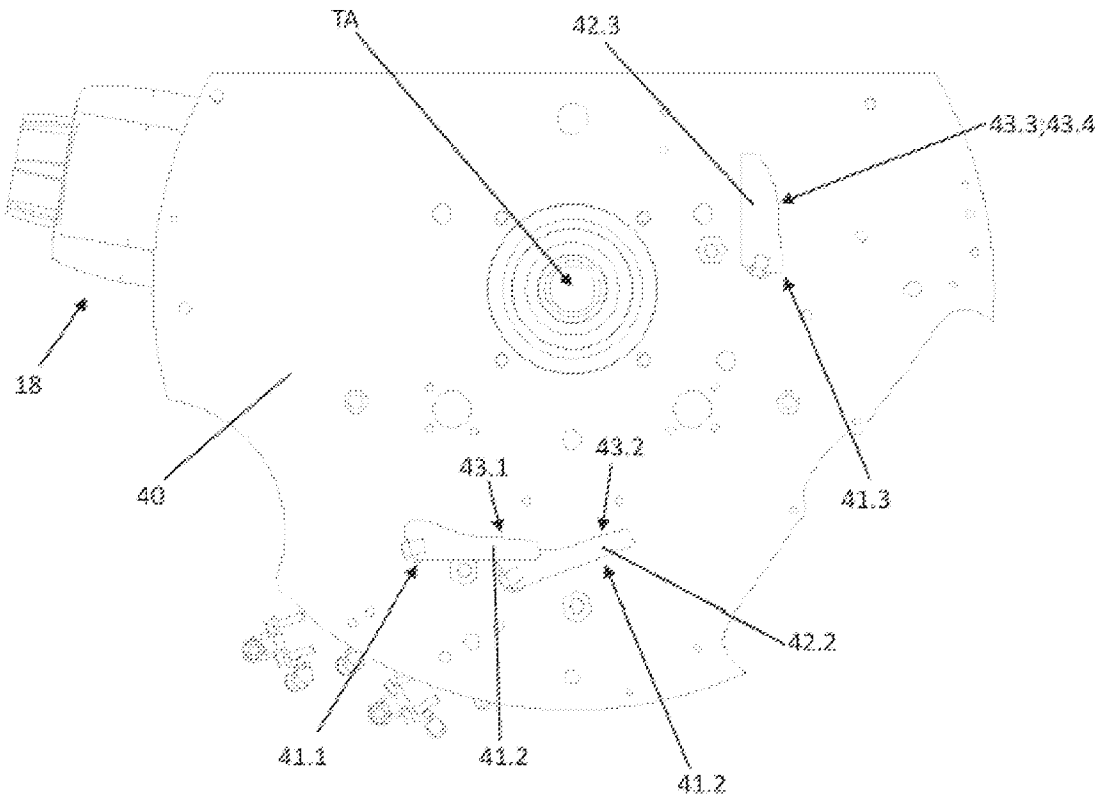
FIG. 4 is a view from above a carrier plate of the vacuum drum shown in FIGS. 2 and 3.
Figure 5:
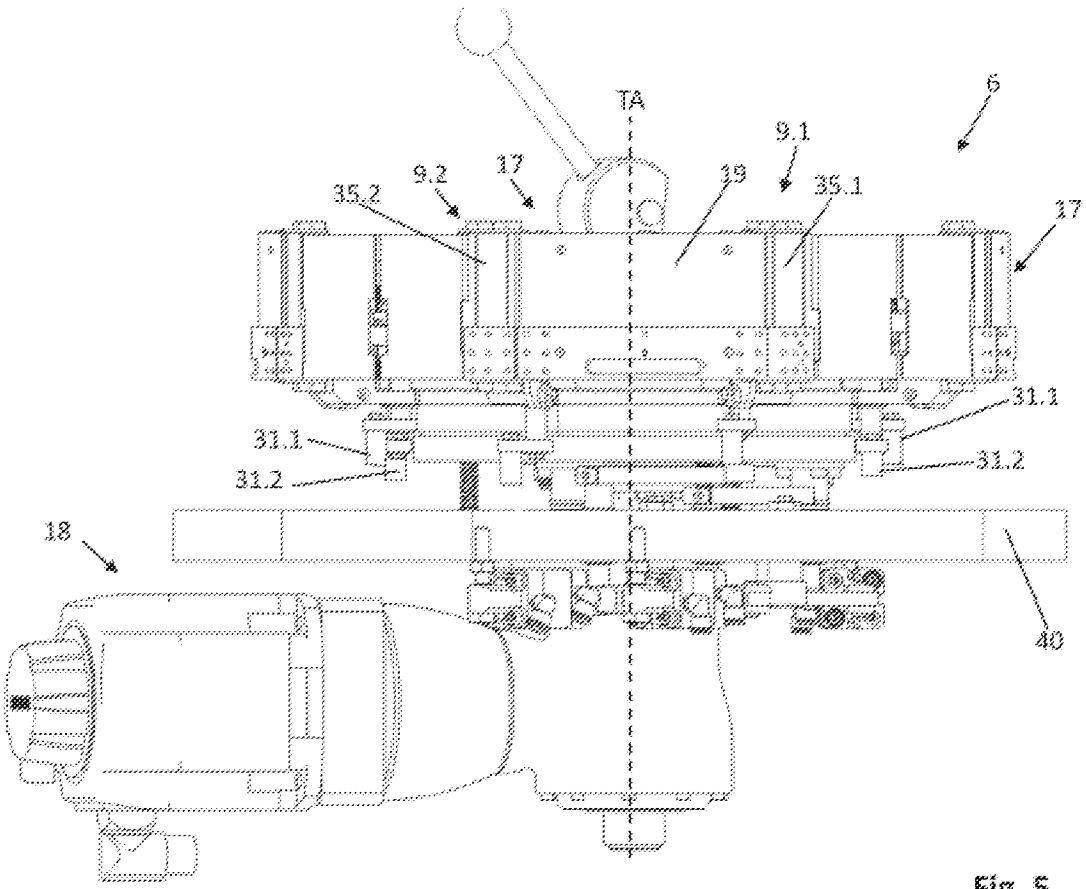
FIG. 5 is a side view of the vacuum drum in FIGS. 1-3.

FIG. 4 shows stationary switch-controllers 41.1, 41.2, 41.3 that are mounted to the base plate 40. A stationary switch controller 41.1, 41.2, 41.3 engages the lever 39, thereby rotating the pivot axle 33 and thus causing a change in which switching surface SF1, SF2 engages the plunger 37. This causes radially outward or inward movement that then causes the rotating switch 30.1, 30.2 to transition between its first and second fixed stationary operating positions BS1, BS2.

Because the plunger 37 is spring loaded, the rotating switch 30.1, 30.2 remains in its last assigned operating position BS1, BS2 without the need for a switching force or retaining force from the associated switch actuator 31.1, 31.2 by way of the stationary switch controllers 41.1 . . . 41.3. The rotating switches 30.1, 30.2 are thus bistable switches.

The vacuum drum 6 is thus a bistable system that can stay in its inner rest position WP or its outer working position AP without any external force. The only force required is that for a switching event associated with changing state. These switching events occur at the beginning or end of a gap in the container flow. The number of switching events is thus related to the number of gaps of missing containers rather than the number of missing containers. This reduces the number of switching events, and hence reduces noise and wear.

Figure 7:
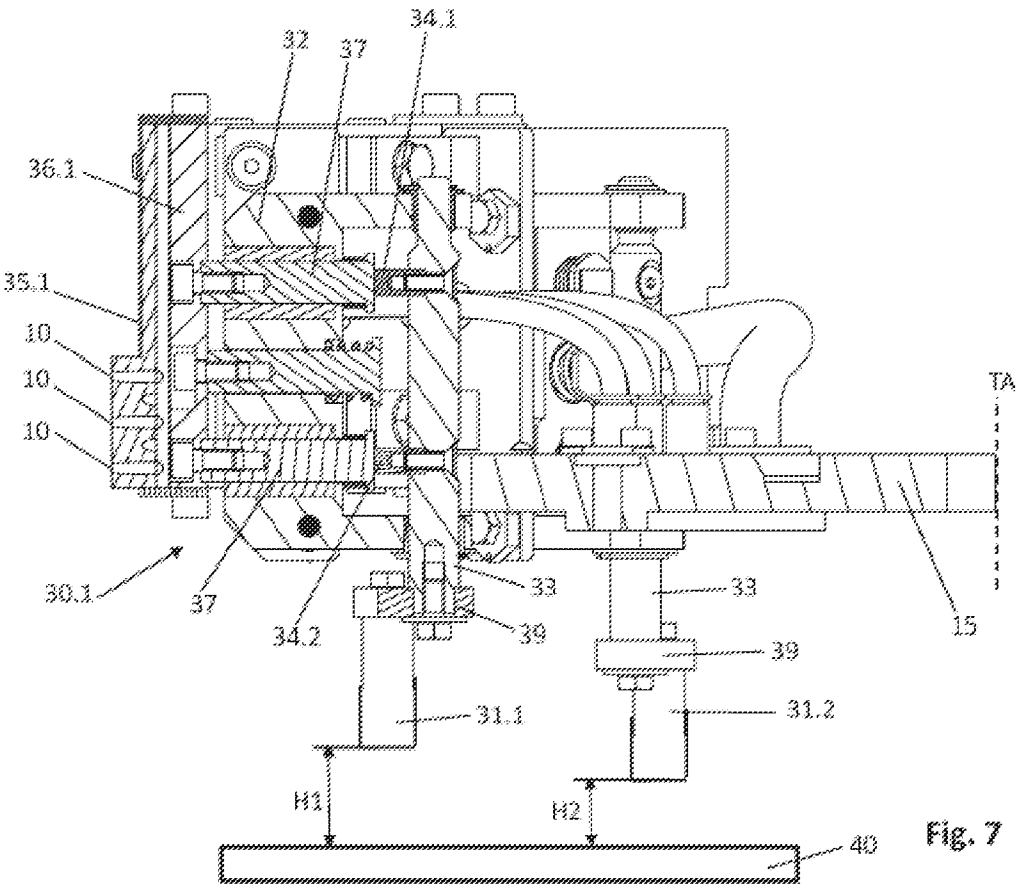
FIG. 7 is a sectional view of the segment shown in FIG. 6.

Referring now to FIG. 7, in some embodiments, free ends of the switch actuators 31.1, 31.2 are at different heights above the base carrier 40. In particular, the free ends of the front switch actuators 31.1 of the front vacuum holders 9.1 lie in a first plane and the free ends of the rear switch actuators 31.2 of the rear vacuum holders 9.2 lie in a second plane. The first and second planes are parallel to the plane of the base carrier 40 but at different heights H1, H2 above the base carrier 40. In particular, the first plane is further from the base carrier 40 than the second plane. Therefore, the free ends of the front switch actuator 31.1 are above the free ends of the rear switching elements 31.2.

To cause a switching event, the switch actuator 31.1, 31.2 is brought into working engagement with at least two switch controllers 41.1, 41.2, 41.3. As shown in FIG. 4, each switch controller 41.1, 41.2, 41.3 comprises a pivotable lever 42.1, 42.2, 42.3 and a control surface 43.1, 43.2, 43.3 for initiating a switching event between operating positions BS1, BS2.

The first switch controller 41.1 is configured such that, as the front switch actuator 31.1 of a corresponding leading holder 9.1 travels past it, the first switch controller's control surface 43.1, which is at the height H1, presses the front switch actuator 31.1 radially-inward towards the drum's axis TA. This switches the front rotating switch 30.1 into the first stationary position BS1. This puts the leading holder 9.1 into the rest position WP.

As the drum 6 continues to rotate, the front switch actuator 31.1 comes out of engagement with the first control surface 43.1. However, the leading holder 9.1 remains in the rest position WP.

The second switch controller 41.2 presses the rear switch actuator 31.2 of a corresponding trailing holder 9.2 as it rotates about the drum's axis TA. In particular, the second control surface 43.2, which is at the height H2, presses radially inward towards the drum's axis TA to cause the rear rotating switch 30.2 to transition into the first operating position BS1, thus placing the trailing holder 9.2 into the rest position WP. Because the switch is bistable, further rotation of the rear switch actuator 31.2 does not change the trailing holder's position.

The third controller 41.3 is configured in this situation such as to press the front and rear switch actuator 31.1, 31.2 of corresponding leading and trailing holders 9.1, 9.2 as they rotate with the drum 6 past the third controller 41.3. The third controller 41.3 features a first control surfaces 43.3 that is located at a distance H1 above the base 40 and a second control surface 43.4 that is located at a distance H2 above the base 40. The first and second control surfaces 43.3, 43.4 of the third controller 41.3 press radially outward in a direction away from the drum's axis TA. This causes the rotating switches 30.1, 30.2 to be switched into the second stationary operating position BS2, in which the leading and trailing holders 9.1, 9.2 are in the working position AP. As the drum 6 continues to rotate, the actuators 31.1, 31.2 come out of engagement with the control surfaces 43.3, 43.4. However, the leading and trailing holders 9.1, 9.2 nevertheless remain in the same position.

In this situation, the switch controllers 41.1 . . . 41.3 are configured so as to be switchable separately from one another.

Having described the invention and a preferred embodiment thereof, what is claimed as new and secured by letters patent is:

The invention claimed is:

1. An apparatus comprising a drum that rotates in a direction-of-rotation about an axis thereof, said drum being a vacuum drum, a holder pair that rotates with the drum, said holder pair comprising vacuum holders that are disposed at a peripheral surface of said drum and that are offset relative to each other along said drum's direction of rotation, wherein said vacuum holders comprise a leading holder that holds a leading edge of a label for labeling a container and a trailing holder that holds a trailing edge of said label, rotating switches that transition between operating positions, switch actuators that cause said rotating switches to transition between said operating positions, and switch controllers that engage said switch actuators to initiate transitions between said operating positions, thereby causing said holders to transition between a rest position, in which said holders are held at a position that avoids application of glue on said label, and a working position, in which said holders are held so as to promote application of glue on said label held by said pair, said switch controllers being stationary, and wherein said rotating switches each comprise a U-shaped carrier having side limbs connected by a base limb, an axle that rotates about an axis that is parallel to said drum's axis, and rocker levers disposed along said axle.

2. The apparatus of claim 1, further comprising segments, wherein said pair of holders is one of a plurality of pairs of holders, wherein each of said segments supports one of said pairs of holders, wherein said plurality of pairs comprises a first pair and a second pair, wherein said first pair is configured to be switched between rest and working positions independently of said second pair.

3. The apparatus of claim 1, wherein said apparatus further comprises a front pad and a rear pad, wherein said front pad is on said leading holder and said rear pad is on said trailing holder, wherein said rotating switches comprise front and rear rotating switches that cause said leading and trailing holders, respectively, to transition between said rest position and said working position.

4. The apparatus of claim 1, further comprising a front nozzle body, a rear nozzle body, a first vacuum pad, and a second vacuum pad, said first vacuum pad being disposed on said front nozzle body and said second vacuum pad being disposed on said rear nozzle body, wherein said rotating switches each comprise side limbs connected by a base limb, a rotatable axle that is parallel to said drum's axis, rocker levers disposed along said axle, and spring-loaded plungers that are biased for movement parallel to said base limb, wherein each of said rocker levers comprises first and second switching surfaces for engaging a first end of said plunger, wherein each of said plungers comprises a second end that is connected to a nozzle body selected from the group consisting of said front nozzle body and said rear nozzle body.

5. The apparatus of claim 1, wherein said rotating switches each comprise a pivot axle and rocker levers securely arranged on said pivot axle so as to pivot between said operating positions, wherein each of said rocker levers comprises a first switching surface and a second switching surface, wherein transitioning between said operating positions occurs as a result of said rocker levers pivoting to-and-fro between said operating positions such that engaging said first switching surface and disengaging said second switching surface causes a transition between said operating positions.

6. The apparatus of claim 1, further comprising front and rear vacuum pads disposed at said holders, wherein said rotating switches each comprise rocker levers, wherein transitioning between said operating positions occurs as a result of pivoting said rocker levers, wherein pivoting said rocker levers results in transitioning said front and rear vacuum pads of a holder between being held in said working position and being held in said rest position.

7. The apparatus of claim 1, further comprising a base carrier that defines a plane perpendicular to said drum's axis, wherein said rotating switches comprise front and rear rotating switches for said leading and trailing holders respectively, wherein said switch actuators comprise a front switch actuator for actuating said front rotating switch and a rear switch actuator for actuating said rear rotating switch, wherein said front and rear switch actuators comprise free ends that are different distances from said base carrier.

8. The apparatus of claim 1, wherein each of said switch controllers comprises a pivotable lever having a control surface for interacting with a switch actuator to cause said transition between said operating positions.

9. The apparatus of claim 1, wherein said switch controllers comprise first, second, and third switch controllers, each of which comprises a pivotable lever and a control surface on said lever and wherein said third controller comprises two control surfaces.

10. The apparatus of claim 1, wherein said switch actuators comprises a first switch actuator, wherein said switch controllers comprise a first switch controller that has a control surface that presses against said first switch actuator in a radially inward direction as said first switch actuator rotates with said drum past said first switch controller, thereby displacing said first switch actuator in a radially inward direction so as to cause said leading vacuum holder to transition into said rest position.

11. The apparatus of claim 1, wherein said switch actuators comprise first and second switch actuators, wherein said switch controllers comprise first and second switch controllers, wherein said first and second switch controllers comprise control surfaces that press against said first and second switch actuators, respectively, in a radially inward direction as said first and second switch actuators rotate with said drum past said first and second switch controllers, thereby displacing said first and second switch actuators in a radially inward direction so as to cause said leading vacuum holder and said trailing vacuum holder to transition into said rest position.

12. The apparatus of claim 1, wherein said switch actuators comprise first, second, and third switch controllers, wherein said first and second switch controllers engage corresponding first and second switch actuators to thereby cause said leading holder and said trailing holder to transition into said rest position and wherein said third switch controller comprises first and second control surfaces that press against said first and second actuators, respectively, in a radially outward direction away from said drum's axis thereby causing said leading holder and said trailing holder to transition into said working position.

13. The apparatus of claim 1, further comprising a labeling machine, wherein said drum is a constituent of said labeling machine, and wherein said labeling machine is configured to draw labels off a roll-fed label and comprises a cutter to cut labels from said roll-fed label, said labels having a length that corresponds to a distance between said leading and trailing holders.

14. The apparatus of claim 1, wherein said vacuum drum is bistable.

* * * * *